US006457597B2

(12) United States Patent
Hirota et al.

(10) Patent No.: US 6,457,597 B2
(45) Date of Patent: Oct. 1, 2002

(54) BEVERAGE CAN CAP AND STRAW

(75) Inventors: Kashichi Hirota; Junji Fukuda, both of Hachioji (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/766,595

(22) Filed: Jan. 23, 2001

(30) Foreign Application Priority Data

Jun. 22, 2000 (JP) ..... 2000-187732

(51) Int. Cl.[7] ..... A47G 19/22

(52) U.S. Cl. ..... 220/258.2; 220/258.5; 220/709; 220/906

(58) Field of Search ..... 220/258, 709, 220/705, 708, 707, 703, 906, 256, 258.1, 258.2, 258.3, 258.4, 258.5, 256.1

(56) References Cited

U.S. PATENT DOCUMENTS

| | | | | | |
|---|---|---|---|---|---|
| 2,957,614 | A | * | 10/1960 | Krajcovic | 220/709 |
| 4,080,989 | A | * | 3/1978 | Chapelsky et al. | |
| 4,917,258 | A | * | 4/1990 | Boyd et al. | 220/258 |
| 5,018,635 | A | * | 5/1991 | Whittaker | 220/709 |
| 5,071,019 | A | * | 12/1991 | Sizemore | 220/709 |
| 5,109,995 | A | * | 5/1992 | Lou | 220/709 |
| 5,203,467 | A | * | 4/1993 | Tucker | 220/717 |
| 5,381,924 | A | * | 1/1995 | Kiefel | 220/709 |

FOREIGN PATENT DOCUMENTS

| | | | | |
|---|---|---|---|---|
| FR | 2695910 | * | 3/1994 | 220/709 |
| GB | 2286584 | * | 8/1995 | |
| JP | 3024479 | | 2/1996 | |
| WO | 97/26200 | * | 7/1997 | |

* cited by examiner

*Primary Examiner*—Nathan J. Newhouse
(74) *Attorney, Agent, or Firm*—Jacobson Holman, PLLC

(57) ABSTRACT

A combination of beverage can cap and straw, including a beverage can cap including a top plate portion and a peripheral rim portion which is to be fitted into a can edge of a beverage can. The beverage can cap being formed with a straw-inserting aperture at a position corresponding to a drinking aperture which is to be opened in a top cover of the beverage can. The beverage can cap being formed with a straw retaining portion on the outer surface of the peripheral rim portion as rising outward in a direction orthogonal to the surface of the top plate portion. The straw retaining portion having a fitting slot capable of retaining a straw fitted thereinto. A straw having a diameter capable of being fitted into the fitting slot formed in the straw-retaining portion. The straw being formed with a bendable accordion-like portion.

3 Claims, 4 Drawing Sheets

BEVERAGE CAN CAP AND STRAW

BACKGROUND OF THE INVENTION

Heretofore, after opening a beverage can, there have been some problems. For example, turning over the beverage can would result in the spill of a beverage in the beverage can through a drinking aperture which has been opened in a top cover of the beverage can by pulling up a pull-tab to drink the beverage therethrough, and dusts entering through the drinking aperture into the beverage can possibly makes an undesirable insanitary condition. Further, a sharp edge of the drinking aperture potentially hurts user' slip or hands, and it would be undesirable from a hygienic point of view to drink with touching user's mouth directly to the beverage can. Some beverage can cap has been known for settling these problems caused after opening the beverage can, such as that described in Japanese Registered Utility Model No. 3024479. This prior art beverage can cap includes a straw-inserting portion provided at a position corresponding to the drinking aperture, a straw-retaining portion provided on the top surface of the beverage can cap, and a closure plug member provided at an upper portion of the beverage can cap, wherein the beverage can cap is mounted on the opened beverage can so as to cover a top cover of the beverage can in its use. A user may insert a straw through the straw-insert portion of the beverage can cap to drink a beverage in the beverage can. When some amount of beverage is left in the beverage can, the straw may be taken out through the straw-inserting portion, and the taken-out straw may be fitted into the straw-retaining portion to keep it for reuse. The opening of the straw-inserting portion may be plugged with the closure plug member so that the beverage in the beverage can would never be spilled out even if the beverage can is turned over.

However, as to storing the straw when the beverage is left in the beverage can, the prior art beverage can cap has the following problems; it is troublesome to take the straw out of the beverage can, to fit it into the straw-retaining portion, and then to plug the opening of the straw-inserting portion with the closure plug member; since the straw is taken out of the beverage can and generally stored as it is, the beverage attached on the straw causes the contamination of hands or surroundings; it is insanitary to reuse the straw with the beverage on which dusts are easily to be attached after storing it under contacting with outside air; and the straw fitted into the straw-retaining portion is obstructive since it protrudes from the top cover of the beverage can to a large degree.

SUMMARY OF THE INVENTION

It is an object of the present invention to settle the above-mentioned problems and to provide a combination of beverage can cap and straw, and a beverage can cap using in such the combination of beverage can cap and straw, which are capable of storing a straw conveniently, without any contamination of hands or surroundings, sanitarily, and unobstructively, when a beverage is left in the beverage can.

In order to achieve the aforementioned object, the present invention provides a combination of beverage can cap and straw, comprising: a beverage can cap including a top plate portion and a peripheral rim portion which is to be fitted into a can edge of a beverage can, the beverage can cap being formed with a straw-inserting aperture at a position corresponding to a drinking aperture which is to be opened in a top cover of the beverage can, the beverage can cap being formed with a straw retaining portion on the outer surface of the peripheral rim portion as rising outward in a direction orthogonal to the surface of the top plate portion, the straw retaining portion having a fitting slot capable of retaining straw fitted thereinto; and a straw having a diameter capable of being fitted into the fitting slot formed in the straw-retaining portion, the straw being formed with a bendable accordion-like portion. The present invention also provides a beverage can cap using in such the combination of beverage can cap and straw.

According to one embodiment of the present invention, the straw-retaining portion may be located on the opposite side of the straw-inserting aperture in a diametrical direction of the top plate portion so as to position a center of the top plate portion between the straw-retaining portion and the straw-inserting aperture.

According to another embodiment of the present invention, a diameter of the straw-inserting aperture may be substantially equal to the diameter of the straw.

According to still another embodiment of the present invention, the straw-retaining portion may be adapted to use as a claw for pulling up a pull-tab of the beverage can.

DESCRIPTION OF THE PREFERRED EMBODIMENT

With reference to a preferable embodiment of the present invention will now be described.

Figure 1:
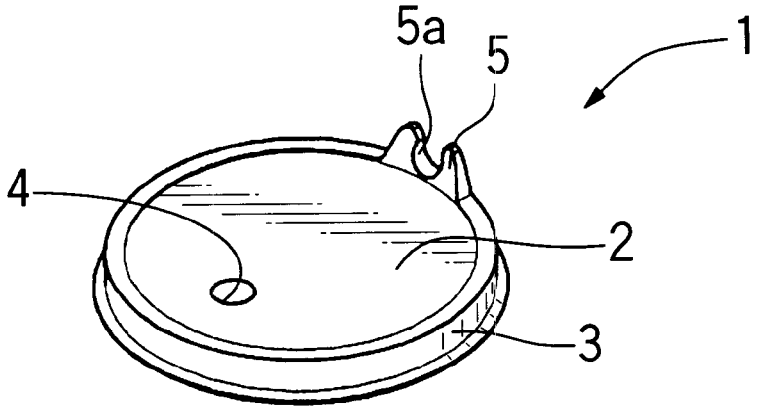
FIG. 1 is a front perspective view showing one example of a beverage can cap according to the present invention.
Figure 2:
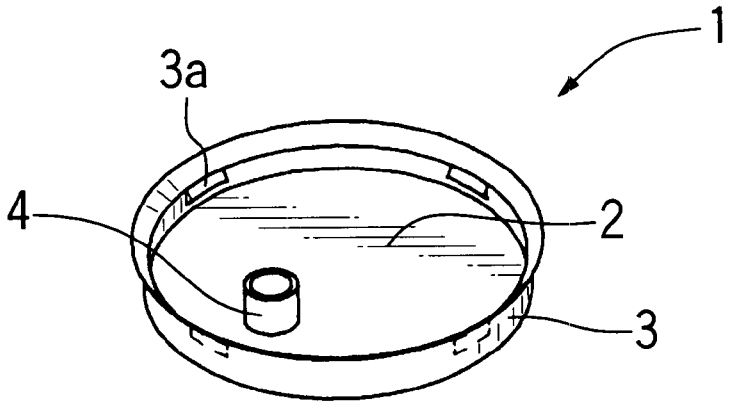
FIG. 2 is a rear perspective view showing the beverage can cap shown in FIG. 1.
Figure 3:
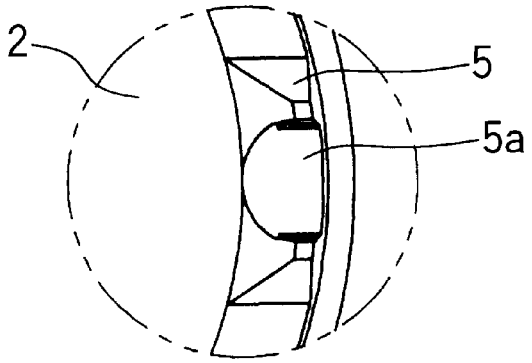
FIG. 3 is an enlarged top plan view showing a straw-retaining portion.
Figure 4:
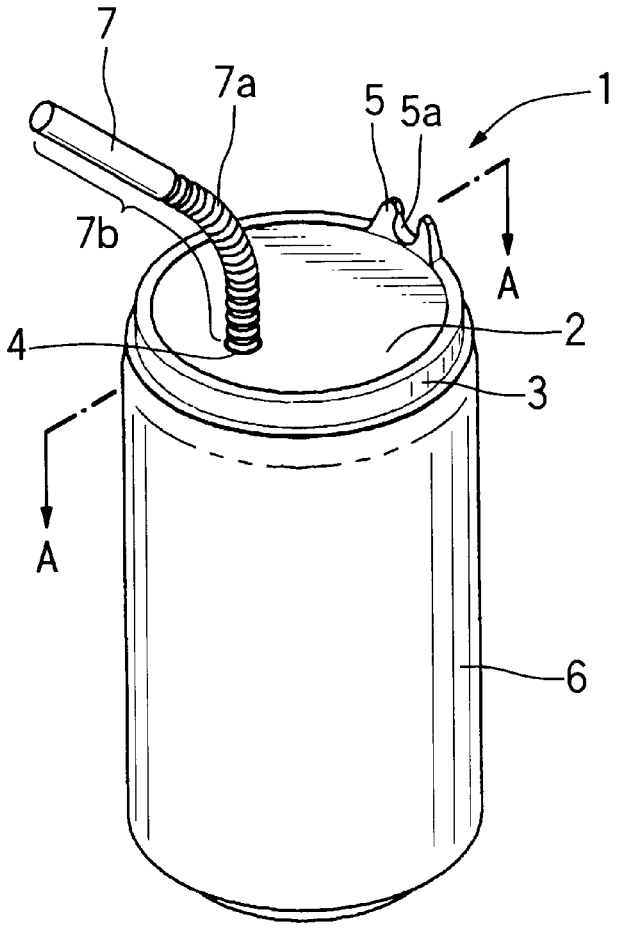
FIG. 4 is a perspective view showing a state that the beverage can cap shown in FIG. 1 is mounted on a beverage can and a straw is inserted into the beverage can.
Figure 5:
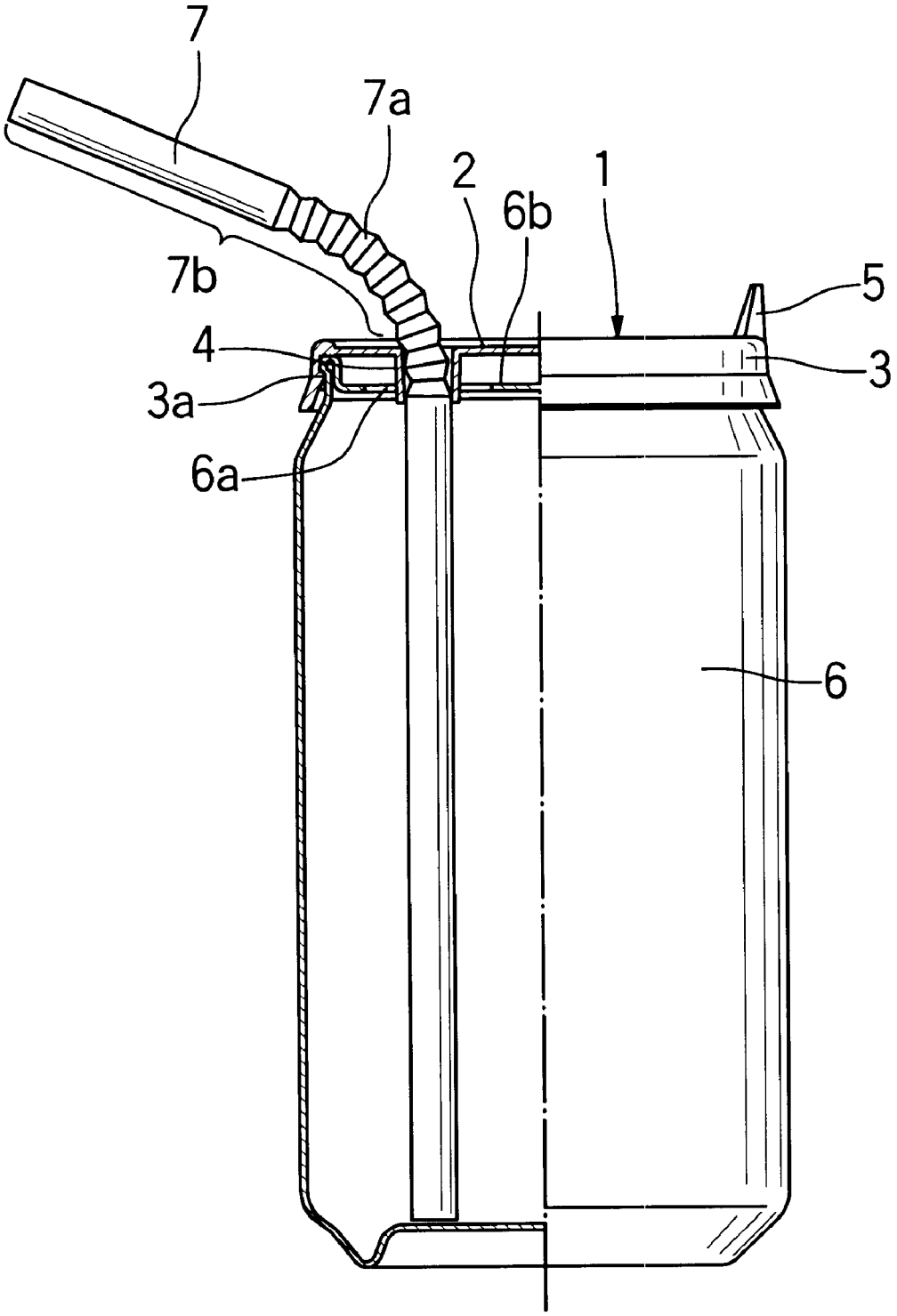
FIG. 5 is a cross-sectional view taken along the line A—A of FIG. 4.
Figure 6:
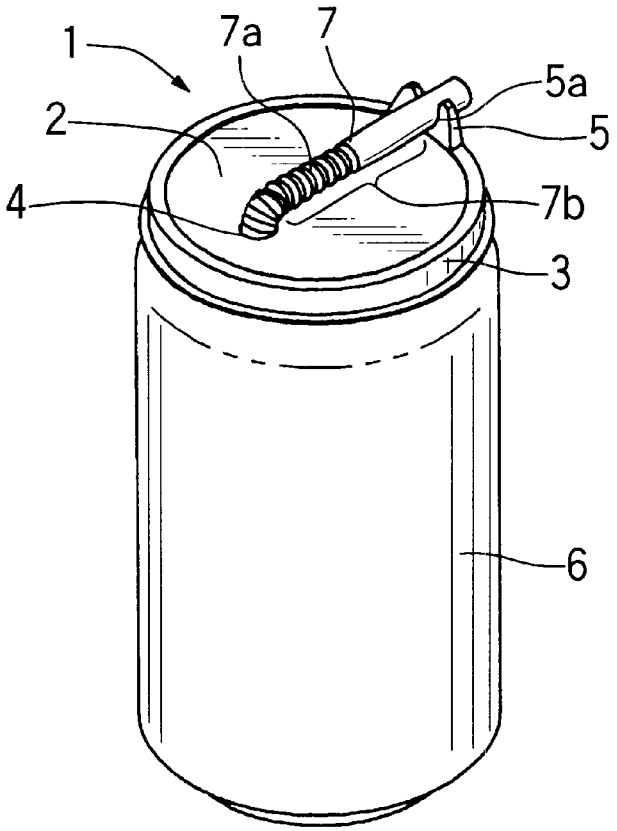
FIG. 6 is a perspective view showing a state that the straw is retained in the straw-retaining portion in FIG. 4.
Figure 7:
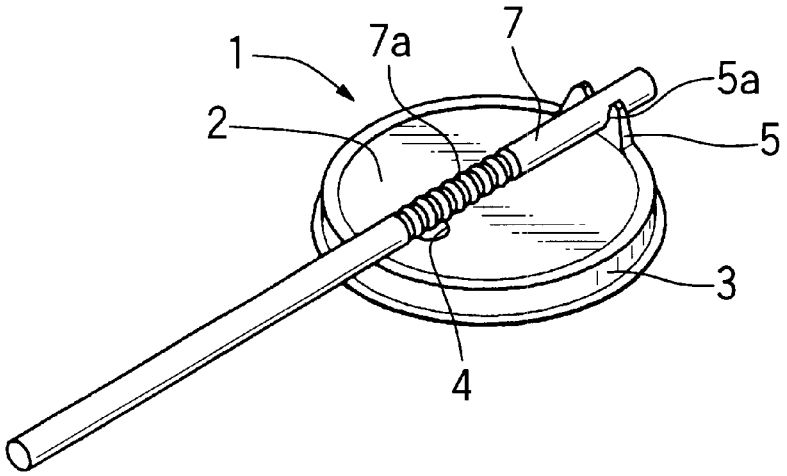
FIG. 7 is a perspective view showing a preferable embodiment for distribution and sales of the beverage can cap shown in FIG. 1 and a straw.

FIG. 1 is a front perspective view showing one example of a beverage can cap according to the present invention; FIG. 2 is a rear perspective view showing the beverage can cap shown in FIG. 1; FIG. 3 is an enlarged top plan view showing a straw-retaining portion; FIG. 4 is a perspective view showing a state that the beverage can cap shown in FIG. 1 is mounted on a beverage can and a straw is inserted into the beverage can; FIG. 5 is a cross-sectional view taken along the line A—A of FIG. 4; FIG. 6 is a perspective view showing a state that the straw is retained in the straw-retaining portion in FIG. 4; and FIG. 7 is a perspective view showing a preferable embodiment for distribution and sales of the beverage can cap shown in FIG. 1 and a straw.

A beverage can cap 1 of the present invention is formed of synthetic resin, such as polyethylene, polypropylene or the like, which is harmless in view of food hygiene and has suitable elasticity or resilience. As shown in FIG. 1 and FIG. 2, the beverage can cap 1 includes a circular top plate portion 2, and an annular peripheral rim portion 3 rising along and from the circumference of the top plate portion 2. The top plate portion 2 is formed with a cylindrical straw-inserting aperture 4 rising from a position eccentric to a center of the top plate portion 2. On the outer surface of the peripheral rim portion 3, a straw-retaining portion 5 is integrally formed as rising outward in a direction orthogonal to the surface of the top plate portion 2. The straw-retaining portion 5 is configured by forming a fitting slot 5*a* in a ligulate member. A plurality of raised portions 3*a* are provided on an inner peripheral wall of the peripheral rim portion 3.

As shown in FIG. 4 to FIG. 6, the beverage can cap 1 is mounted on a beverage can 6 so as to cover a top cover 6*b* of the beverage can 6, in actual use. A user can mount the beverage can cap 1 to the beverage can 6 by pushing the beverage can cap 1 downward, or from above, after putting up the beverage can cap 1 on the top cover 6*b* of the opened beverage can 6 so as to locate the straw-inserting aperture 4 directly above a drinking aperture 6*a* of the beverage can 6, and can then insert a straw 7 into the straw-inserting aperture 4 to drink a beverage in the beverage can 6. The straw 7 includes any suitable straws having a bendable accordion-like portion 7 in a part of its sidewall, such as the trade name "Bender Straw", which is popularly distributed and soled. As best shown in FIG. 5, the beverage can cap 1 is mounted on the beverage can 6 so as to closely press and fit the inner peripheral wall and raised portion 3*a* of the peripheral rim portion 3 to the upper can edge of the beverage can 6. A diameter of the straw 7 is substantially equal to a diameter of the straw-inserting aperture 4 so that the straw 7 passes through the straw-inserting aperture 4 so as to contact the outer surface of the straw 7 substantially with the periphery of the straw-inserting aperture 4. Particularly, in the this embodiment, the straw-inserting aperture 4 is not formed only by perforating the top plate portion 2, but formed in a cylindrical configuration so that the touch area between the straw 7 and the straw-inserting aperture 4 is enlarged. Thus, when the beverage can cap 1 is mounted on the beverage can 6 and the straw 7 is inserted into the straw-inserting aperture 4, high air tightness is maintained between the peripheral rim portion 3 of the beverage can cap 2 and a peripheral edge portion of the top cover 6*b* of the beverage can 6 and between the straw 7 and the straw-inserting aperture 4. As a result, a top opening having a diameter of about 5 mm to 6 mm of the straw 7 is left as a sole opening portion for allowing fluid communication between inside of the beverage can 6 and outside air. Thus, even if the beverage can 6 is turned over and the beverage spills out from the drinking aperture 6*a* of the beverage can 6, the spilt beverage will not get out of contacting portions between the peripheral rim portion 3 of the beverage can cap 2 and the peripheral edge portion of the top cover 6*b* of the beverage can 6 and between the straw 7 and the straw-inserting aperture 4. In addition, due to external pressure, the beverage in the beverage can 6 is difficult to get out of the top opening of the straw 7.

As shown in FIG. 6, when the beverage is left in the beverage can 6, the user may bend an upper portion 7*b* of the straw 7, which protrudes upward from the top plate portion 2, at the accordion-like portion 7*a*, and then fit a part of the upper portion 7*b* of the straw 7 into the fitting slot 5*a* to retain the straw 7, so that the straw 7 can be stored in a state inserted into the beverage can 6 and bended. Thus, since the straw 7 is stored in the state bended without taken out, it can be stored conveniently, without any contamination of hands or surroundings, and sanitarily. Further, the straw 7 is stored in the state bended so as to reduce the upward protrusion of its upper portion 7*b* so that it can be stored unobstructively. When storing in this manner, even if the beverage can 6 is turned over, the beverage is also difficult to get out of the beverage can 6, as described above.

When the straw 7 is inserted into the beverage can 6, the lower end of the straw 7 desirably lie close to the bottom of the beverage can 6 so that the beverage in the beverage can 6 can be fully drunk. The accordion-like portion 7*a*, or a portion having a plurality of accordion pleats, is desirably located close to the straw-inserting aperture 4 so that the upward protrusion of the upper portion 7*b* can be minimized by bending the accordion-like portion 7*a* to make the upper portion 7*b* extend along the upper surface of the top plate portion 2. When bended as described above, the upper portion 7*b* of the straw 7 desirably has an unobstructive length, which allows the upper portion 7*b* to stay within the circumference of the top plate portion 2, and preferably at least 30 mm or more to improve convenience for drinking. In this embodiment, for satisfying these requirements, the straw-retaining portion 5 is located on the opposite side of the straw-inserting aperture 4 in a diametrical direction of the top plate portion 2 so that the upper portion 7*a* of the straw 7 inserted into the straw-inserting aperture 4 can be bended in the direction bringing into the longest distance between the straw-inserting aperture 4 and the circumference of the top plate portion 2, or toward the center of the top plate portion 2, to be retained.

The straw-retaining portion 5 may be used as a claw for pulling up a pull-tab of the beverage can 6. When opening a beverage can, a user may insert the straw-retaining portion 5 between the top cover 6*b* of the beverage can 6 and the pull-tab and then operate the beverage can cap 1 so that the pull-tab can be pulled up more easily without hurting finger or nail. As shown in FIG. 7, in distribution and sales, a user may fit the straw 7, which is not inserted into the straw-inserting aperture 4, into the fitting slot 5*a* of the straw-retaining portion 5 so that the straw 7 and the beverage can cap 1 can be distributed or soled in a non-separated and non-bulky form.

In the above-described embodiment, the beverage can cap 1 and the straw 7 have been formed as an individual member respectively. However, these may be integrally formed as a beverage can cap with straw in which the straw 7 is fixedly penetrated the beverage can cap 1.

As described above, in a combination of beverage can cap and straw of the present invention, a bendable straw is applied as the straw. When the beverage in the beverage can is left, the straw can be stored by bending the upper portion at the accordion-like portion without taken out it and then fitting the upper portion into the fitting slot of the straw-retaining portion. Thus, the straw can be stored conveniently, without any contamination of hands or surroundings, and sanitarily. Further, the straw is stored in a state bended to reduce the upward protrusion of its upper portion so that it can be stored unobstructively.

What is claimed is:

1. A combination of beverage can cap and straw, comprising:

a beverage can cap including a top plate portion and a peripheral rim portion which is to be fitted into a can edge of a beverage can, said beverage can cap being formed with a straw-inserting aperture at a position corresponding to a drinking aperture which is to be opened in a top cover of said beverage can, said beverage can cap being formed with a straw retaining portion having a fitting slot on an outer surface of said peripheral rim portion as rising outward in a direction orthogonal to a surface of said top plate portion, said straw retaining portion being capable of being used as a claw for pulling up a pull-tab of said beverage can cap; and a straw including an upper portion and having a diameter capable of being fitted into said fitting slot formed in said straw-retaining portion, said straw having a bendable portion in at least a part of a sidewall located adjacent to the straw-inserting aperture and extending upwardly from the straw-inserting aperture so that the upper portion of the straw can extend along an upper surface of the top plate portion so that when in use, the straw can be stored by bending the bendable portion of the straw and fitting the upper portion of the straw into the fitting slot of the straw-retaining portion.

2. The combination of beverage can cap and straw as defined in claim 1, wherein said straw-retaining portion is located on the opposite side of said straw-inserting aperture in a diametrical direction of said top plate portion so as to position a center of said top plate portion between said straw-retaining portion and said straw-inserting aperture.

3. The combination of beverage can cap and straw as defined in claim 1, wherein a diameter of said straw inserting aperture is substantially equal to said diameter of said straw.

* * * * *